US007765745B2

(12) United States Patent
Kmet et al.

(10) Patent No.: US 7,765,745 B2
(45) Date of Patent: Aug. 3, 2010

(54) REUSABLE WORKER HOUSING AND METHODS RELATING THERETO

(75) Inventors: Walter A. Kmet, Calgary (CA); Stefan Kalny, Calgary (CA); Lorne E. Hillier, Calgary (CA)

(73) Assignee: Atco Structures & Logistics Ltd., Calgary (CA)

( * ) Notice: Subject to any disclaimer, the term of this patent is extended or adjusted under 35 U.S.C. 154(b) by 0 days.

(21) Appl. No.: 12/198,481

(22) Filed: Aug. 26, 2008

(65) Prior Publication Data

US 2008/0313974 A1 Dec. 25, 2008

Related U.S. Application Data

(62) Division of application No. 10/543,383, filed as application No. PCT/CA2004/000099 on Jan. 27, 2004.

(30) Foreign Application Priority Data

Jan. 29, 2003 (CA) ..... 2417593

(51) Int. Cl.
*E04H 6/00* (2006.01)

(52) U.S. Cl. ..... 52/79.9; 52/79.1; 52/79.7; 52/79.8; 52/79.12

(58) Field of Classification Search ..... 52/69.1, 52/79.7, 79.8, 79.9, 79.5, 143; 446/476, 446/477, 478

See application file for complete search history.

(56) References Cited

U.S. PATENT DOCUMENTS

| | | | | |
|---|---|---|---|---|
| 2,154,142 | A | 4/1939 | Whelan | |
| 2,248,805 | A * | 7/1941 | Cocken, Jr. | 52/106 |
| 2,634,462 | A | 4/1953 | Graven | |
| 2,706,313 | A | 4/1955 | Radman | |
| 2,893,066 | A | 7/1959 | Perdue | |
| 3,254,914 | A | 6/1966 | Steck | |
| 3,434,253 | A | 3/1969 | Hatcher | |
| 3,436,877 | A | 4/1969 | Gunning | |
| 3,492,767 | A | 2/1970 | Pincus | |
| 3,527,002 | A | 9/1970 | Mead | |

(Continued)

FOREIGN PATENT DOCUMENTS

DE 20 12 870 A 10/1971

(Continued)

OTHER PUBLICATIONS

Atco Structures Inc., 49 Person Dormitory, available prior to Jan. 29, 2003.

(Continued)

*Primary Examiner*—Richard E Chilcot, Jr.
*Assistant Examiner*—Alp Akbasli
(74) *Attorney, Agent, or Firm*—Bennett Jones LLP

(57) ABSTRACT

Consideration is given to parameters for providing re-use of worker housing in similar, or the same, applications at other sites or other projects as well as parameters governing re-use for alternate secondary uses usually common to the area of initial use, thereby avoiding transport for long distances or wasteful disposal of worker housing structures. Secondary uses for manufactured worker housing modules according to the present invention can be, for example, smaller or reconfigured dormitory-style housing or residences or family housing.

10 Claims, 13 Drawing Sheets

U.S. PATENT DOCUMENTS

| | | | | | |
|---|---|---|---|---|---|
| 3,552,075 | A | | 1/1971 | Crump | |
| 3,601,521 | A | | 8/1971 | Morton | |
| 3,613,321 | A | * | 10/1971 | Rohrer | 52/73 |
| 3,724,143 | A | * | 4/1973 | Paukulis | 52/79.2 |
| 3,765,714 | A | | 10/1973 | Lau | |
| 3,778,528 | A | | 12/1973 | Heifetz et al. | |
| 3,834,110 | A | | 9/1974 | Vercelleto | |
| 3,852,924 | A | | 12/1974 | Levenson | |
| 3,879,050 | A | | 4/1975 | Young | |
| 3,971,174 | A | * | 7/1976 | van der Lely | 52/79.8 |
| 3,992,848 | A | | 11/1976 | Stucky | |
| 4,050,215 | A | | 9/1977 | Fisher | |
| 4,084,834 | A | | 4/1978 | Becker | |
| 4,155,204 | A | | 5/1979 | Prozinski | |
| 4,179,857 | A | | 12/1979 | Danford | |
| 4,261,613 | A | | 4/1981 | Alford | |
| 4,372,087 | A | * | 2/1983 | Kump | 52/79.12 |
| 4,501,098 | A | | 2/1985 | Gregory | |
| 4,573,292 | A | | 3/1986 | Kaufman et al. | |
| 4,573,302 | A | * | 3/1986 | Caretto | 52/745.02 |
| 4,599,829 | A | * | 7/1986 | DiMartino, Sr. | 52/79.7 |
| 4,745,719 | A | | 5/1988 | Blankstein et al. | |
| 4,970,834 | A | * | 11/1990 | Polson | 52/106 |
| D314,164 | S | | 1/1991 | Barber et al. | |
| 5,054,843 | A | | 10/1991 | Gray | |
| 5,070,661 | A | | 12/1991 | Lo Guidici | |
| 5,265,384 | A | | 11/1993 | Menke et al. | |
| 5,274,502 | A | * | 12/1993 | Demerritt et al. | 359/642 |
| 5,353,557 | A | * | 10/1994 | Lerner et al. | 52/106 |
| 5,353,558 | A | | 10/1994 | Shea et al. | |
| 5,553,429 | A | | 9/1996 | Schuster | |
| 5,553,961 | A | | 9/1996 | Olden | |
| 5,724,774 | A | | 3/1998 | Rooney | |
| 5,809,704 | A | | 9/1998 | Stewart et al. | |
| 5,966,890 | A | | 10/1999 | Inman | |
| 6,044,610 | A | | 4/2000 | DeVon et al. | |
| 6,076,311 | A | | 6/2000 | Godfrey | |
| 6,141,924 | A | | 11/2000 | Quaintance | |
| 6,243,993 | B1 | * | 6/2001 | Swensson | 52/79.5 |
| 6,260,322 | B1 | | 7/2001 | Lindsay | |
| 6,393,774 | B1 | * | 5/2002 | Fisher | 52/79.1 |
| 6,393,775 | B1 | | 5/2002 | Staschik | |
| 6,493,996 | B1 | * | 12/2002 | Alexander et al. | 52/79.9 |
| 6,668,496 | B1 | | 12/2003 | Clapp et al. | |
| 6,675,540 | B1 | | 1/2004 | Rokes | |
| 6,691,475 | B1 | * | 2/2004 | Tiongco et al. | 52/234 |
| 6,920,721 | B2 | | 7/2005 | Johns et al. | |
| 6,951,079 | B2 | | 10/2005 | Weiss | |
| 6,981,347 | B1 | | 1/2006 | Walburger | |
| 7,032,351 | B2 | * | 4/2006 | Redman | 52/34 |
| 2002/0170243 | A1 | * | 11/2002 | Don et al. | 52/79.7 |
| 2003/0041531 | A1 | | 3/2003 | Seldon | |
| 2003/0177721 | A1 | * | 9/2003 | Wong | 52/234 |
| 2004/0103597 | A1 | | 6/2004 | Ellenberger | |
| 2006/0059792 | A1 | * | 3/2006 | Tiramani | 52/79.1 |

FOREIGN PATENT DOCUMENTS

| | | | |
|---|---|---|---|
| DE | 25 31 914 | | 2/1977 |
| DE | 32 08 302 | A | 9/1982 |
| FR | 2718178 | | 10/1995 |
| GB | 1 424 238 | A | 2/1976 |
| WO | WO 94/05879 | | 3/1994 |
| WO | WO 00/01898 | | 1/2000 |
| WO | WO 00/57004 | | 9/2000 |

OTHER PUBLICATIONS

Atco Structures Inc., 42 Man Complex Specifications, 3M Jul. 1989.

* cited by examiner

REUSABLE WORKER HOUSING AND METHODS RELATING THERETO

FIELD OF THE INVENTION

This invention relates to worker housing and, in particular, structures and methods relating to constructing and reusing worker housing and worker housing modules.

BACKGROUND OF THE INVENTION

Worker housing structures are known by many names including bunk houses, workmen dormitories, living containers, man camp accommodation and industrial housing to name a few. Specifically, worker housing structures are accommodations for work persons temporarily housed at a site that has little or no accommodation facilities. The worker housing structures include sleeping and ablution facilities for the work persons. Generally, worker housing is in the form of complexes each complex configured to contain, for example, 60 or more workers on each level. Each complex is formed of several individual manufactured modules joined together. Each module is in turn formed of two worker housing units joined together. The units may be sized to be readily transportable over public roadways, railways or by boat.

The size and configuration of each module and complex is usually determined by the manufacturers of worker housing to provide the most economical solution to the parameters governing worker accommodation for a specific site or project. Consequently, the requirements determining the configuration of worker housing modules and their detailed construction are variables specific to each site at which they will be used, including for example, the natural environment, the terrain, the level of comfort desired for the workmen, the logistics required to get the units and supplies to the work site, the length of the project, the requirements of labor guilds (trade unions), the local Building Codes, and the financial constraints set by the entity responsible for the cost of construction of the total project. Generally, those responsible for, or having jurisdiction over, a specific project will define the site-specific criteria with respect to housing the workforce and the manufacturers of the workers living modules or others having access to previously manufactured worker housing, will offer equipment that meets the site-specific criteria.

Manufactured worker housing modules are sometimes re-used after their initial use to accommodate workers at other construction projects having housing parameters similar to those governing the original one. Usually, the housing modules have to be re-used in their original configuration or with minor modifications to meet minor differences in site conditions, governing bodies or criteria requested by the client responsible for their re-use as worker housing. Manufacturers have concentrated on providing re-use in the same use as the initial use. In particular, to enhance the re-use of manufactured worker housing, the manufacturers of workers living modules and those responsible for the specific projects, have sought to standardize many of the building requirements so that they do not vary significantly from one specific project to the next. Also, manufactures, have at times planned for re-use by considering generalized criteria other than those defined for the initial use to ensure that the worker housing modules may be re-used on projects in other geographical areas and that they will meet site specific criteria or be readily modified to meet special criteria required of the various agencies having jurisdiction in the area of re-use.

The manufacturers usually sell or lease the worker housing equipment for the duration of the specific project. They move the equipment to the specified site, make it operational at the site and provide operational support during the equipment's use. When the equipment is no longer needed, the manufacturers sometimes buy back the equipment and/or move it to a predetermined location, usually a marshaling yard, a significant distance from the project site. Other times, where it is difficult or costly to move the units or the units are so site-specific as to render them of little value for reuse, the worker housing modules are simply abandoned or discarded. After particularly large projects, many modules are discarded or abandoned due to oversupply. Many modules are also discarded or abandoned from projects in remote locations, but are generally of little value due to specific design for reuse only as a dormitory for housing numerous persons.

SUMMARY OF THE INVENTION

A reusable worker housing structure, methods for building a reusable worker housing structure and for reusing a worker housing structure have also been invented.

The invention considers parameters for providing re-use of worker housing in similar, or the same, applications at other sites or other projects as well as parameters governing re-use for alternate secondary purposes usually common to the area of initial use, thereby avoiding transport for long distances or wasteful disposal of worker housing structures.

Secondary uses for manufactured worker housing modules according to the present invention can be, for example, smaller or reconfigured worker housing or residences or family housing.

For example, secondary uses can include family housing, worker, institutional, instructional and or detention facilities having, for example, a combination of sleeping, messing, ablution and/or assembly areas for a population living within the confines of a specific building comprising one or more modules.

In one embodiment, the invention allows for the conversion of a worker housing complex to homes for housing families that may be indigenous to the area of initial use of the complex. The homes can be, for example, configured as conventional detached, semi-detached or attached residential homes. The ability to reuse worker housing as family housing may offer significant economical benefits to the people responsible for the initial project, if the manufactured worker housing modules can be used in this manner in an area at or near the project site, including mitigating the costs of transporting the modules to another project and/or the costs of disposal if re-use is not a viable option and the elimination of idle time before re-use if use in another job site is not readily available.

Worker modules and complexes are formed from worker units. The units may be constructed to be of a size suitable for transport, but are joined together at the job site to form the modules and complexes.

Where any particular unit is intended to be used in a large worker complex but then reusable in a smaller secondary application, such as a smaller stand alone worker module such as for 10 people or for a detached or semidetached house, some consideration will be given at the time of unit construction to facilitate such reuse. For example, in one embodiment washrooms may be limited in size and distributed through the units in the complex, rather than being grouped in one wash car. Washrooms may, for example, be selected to contain at most three of any one fixture such as toilets, sinks or showers. In one embodiment, washrooms may be limited to contain no more than two toilets and two showers. In another embodiment, a unit that is constructed to contain rooms containing plumbing may also contain rooms without plumbing since most secondary applications will not require units that contain only plumbing-containing rooms. In some embodiments, plumbing fixtures may be installed that facilitate removal thereof so that the unit can be converted more easily for a purpose requiring fewer fixtures.

In a worker complex, some units may contain few plumbing fixtures. The use of plumbing walls can be advantageous in such units, as it permits easy connection to existing plumbing, including water supply, waste, and venting, to facilitate installation of additional plumbing fixtures should that be required in a secondary application.

Where a complex is to be used for residential housing or stand alone worker meal preparation, it is desirable to construct at least some units of the complex to have a room convertible to a kitchen. This unit may have at least some plumbing connections and a room containing at least some roughed-in electrical provisions suitable for a kitchen. For example, with respect to the electrical requirements for a range, a conduit can be provided at a position within the unit for accepting the electrical cables to be installed at the time of conversion of the worker housing or the cables can be installed to a position within the unit and covered by wall panels or dummy covers, but accessible for conversion. The room may also contain greater numbers of electrical outlets and at least some electrical outlets may be at a height from the floor which is correct for a position above a countertop should a countertop be installed at conversion.

In a unit intended for reuse for a secondary application, after its initial use in a worker housing is complete, it is desirable that at least some wall partitions be easily removable and/or repositionable within the unit or another unit.

Thus, in accordance with a broad aspect of the present invention, there is provided a worker housing unit for initial use in constructing a worker housing structure to accommodate a plurality of personnel and capable of being reused to construct another form of residence, comprising: an exterior wall formed suitable for exposure to the exterior of a building; an openable side suitable for connection to other units to form a worker housing structure; a heat generating appliance capable of generating heat for heating the module; a plurality of interior partitions forming at least a first bedroom and a second bedroom; a plumbing room in which there is piping to support a plumbed-in water supply and sanitary liquid waste disposal system; and the worker housing unit being pre-built to include an internal configuration supporting conversion to a secondary use after its initial use, the secondary use being other than the initial use.

The internal configuration may include room layout, positioning or provision of services, mechanisms, devices, building components, building systems, etc. In one embodiment for example, the internal configuration includes a room in which there is an electrical system rough-in suitable for supporting at least some kitchen electrical requirements. In another embodiment, the internal configuration may include provision in the plumbing room of at least two operable sinks, at least two operable toilets, urinals or a combination thereof; and at least one operable shower. The sinks may be, for example, lavatories or tub-type sinks. The sinks, toilets/urinals and shower can be accommodated wholly or partially in the room in which there is provided a plumbed-in water supply and a sanitary liquid waste disposal piping system.

The plumbed-in water supply and liquid waste system can be provided but not connected to any plumbing fixture (i.e. roughed-in). Alternately, the plumbed-in water supply and sanitary liquid waste disposal piping system can be connected to an operable plumbing fixture.

The unit can include a third bedroom and/or a room in which there is an electrical system rough-in suitable for supporting at least some kitchen electrical requirements.

In accordance with a broad aspect of the present invention, there is provided a worker housing module to accommodate a plurality of personnel and capable of being converted into another form of residence, comprising: at least four exterior walls each wall formed suitable for exposure to the exterior of a building; a heat generating appliance capable of generating heat for heating the module; a plurality of interior partitions; a first bedroom; a second bedroom; a plumbing room for which there is piping provided to support a plumbed-in water supply and a sanitary liquid waste disposal piping system; a room in which there is an electrical system rough-in suitable for supporting at least some kitchen electrical requirements and an access point for interior access to an adjacent worker dormitory module, the access point being closable for conversion to a module for another purpose.

Each module may generally be formed of two units joined together. Thereby, the individual units can be, if desired, sized and constructed for ease of transport, but can be joined together to produce a more spacious module.

The plumbed-in water supply and liquid waste system can be provided but not connected to any plumbing fixture. Alternately, the plumbed-in water supply and sanitary liquid waste disposal piping system can be connected to an operable plumbing fixture. In one embodiment, the plumbing room is a bathroom including an operable toilet and an operable washing fixture.

The electrical system rough-in suitable for supporting at least some kitchen electrical requirements can include, for example, a conduit through which can be installed a power supply conductor suitable for a electrical range, a roughed in electrical connection in the room suitable for an electrical range and/or electrical outlets positioned a distance from the floor suitable for spacing above a counter top.

In one embodiment, the module includes a truss roof and other features which render it more applicable for reuse as a residential house including, for example, eaves extending past the exterior walls, exterior cladding materials of, for example, shingles and siding. The module may be produced to be convertible to a selected secondary application and many of the building systems and components, such as insulation, mechanical units, electrical systems and plumbing systems, are selected in the module to be suitable for the secondary application. For example, the module for worker housing can be produced to be suitable for worker housing and to be convertible to a detached or a semi-detached house, including at least some building components and systems meeting the building codes for residential houses, for example, with respect to wiring, insulation, heating and/or emergency escape, etc. For example, residential housing will generally require two exterior doors, a kitchen and at least one washroom in each separate house, rooms intended for bedrooms will often require windows of a required size, etc. It is also generally desirable that a residential house contain connections for clothes washing appliances, etc.

When constructing a complex in which the units are intended to be used for secondary applications relating to smaller worker housing or family housing, it is desirable generally to use substantially equal or greater numbers of units containing plumbing fixtures when compared to the number of units without plumbing connections, especially where the complex is intended for residential housing. This is desirable since it is easier to reuse units already containing plumbing than to require installation of plumbing at the time of reuse. In a complex containing reusable units, it is also cost effective to provide substantially even numbers of units containing HVAC appliances and units without these appliances, as the units can be combined for secondary application and thereby share the HVAC appliances.

In accordance with another broad aspect of the present invention, there is provided a worker complex structure for holding a plurality of personnel and capable of being separated into a plurality of smaller modules, comprising: a plurality of modules arranged in side by side configuration, each module including at least four exterior walls each wall formed suitable for exposure to the exterior of a building, a furnace capable of generating heat for heating the module, a first bedroom, a second bedroom and a room in which there is provided a plumbed-in water supply; and an interior access between adjacent modules.

In accordance with yet another broad aspect of the present invention, there is provided a method for constructing a worker housing complex including a plurality of worker housing units, the method comprising: reviewing any requirements of the worker housing complex to be constructed; considering a possible secondary use for at least a portion of the plurality of worker housing units to be used in the worker housing complex; planning the worker housing complex based on the requirements; constructing the plurality of worker housing units to form the planned worker housing complex; pre-building the portion of the plurality of worker housing units to support conversion to the possible secondary use; and assembling the plurality of worker housing units to form the worker housing complex.

In accordance with a broad aspect of the present invention, there is provided a method for building a worker complex to hold a plurality of personnel and capable of being separated into a plurality of smaller modules, comprising: providing a plurality of modules, each module including at least four exterior walls each wall formed suitable for exposure to the exterior of a building, a furnace capable of generating heat for heating the module, a first bedroom, a second bedroom and a room in which there is provided a plumbed-in water supply; arranging the modules in side by side configuration; and providing interior access between adjacent modules.

In accordance with yet another broad aspect of the present invention, there is provided a method for reusing a worker complex: providing a worker complex including a first module and an adjacent module arranged in side by side configuration, each module capable of accommodating a plurality of personnel and of being converted into a module for another purpose and including at least four exterior walls each wall formed suitable for exposure to the exterior of a building, a furnace capable of generating heat for heating the module, a first bedroom, a second bedroom and a room in which there is provided a plumbed-in water supply; and an interior access between the first module and the adjacent module; and separating the first module and the adjacent module such that each module stands alone and the interior access between the modules is cut off.

In one embodiment, the methods include, prior to providing the worker complex, selecting the worker complex requirements based on a proposed reuse application. This may include consideration of building codes for the proposed reuse application.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DETAILED DESCRIPTION OF THE PRESENT INVENTION

Figure 1A:
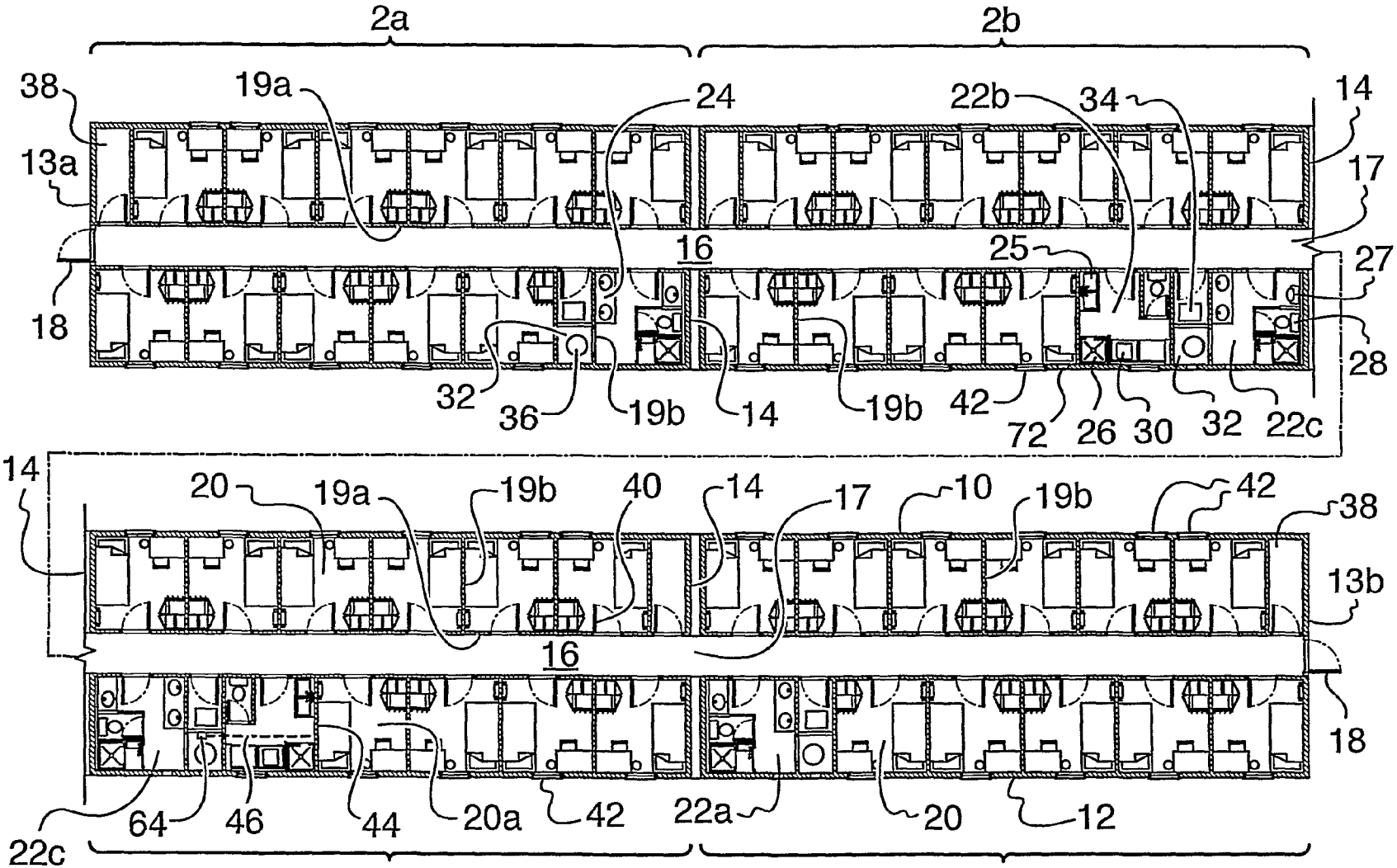
FIG. 1A is a plan view of a worker housing complex according to the present invention including units suitable for reuse in at least one secondary application.
Figure 1B:
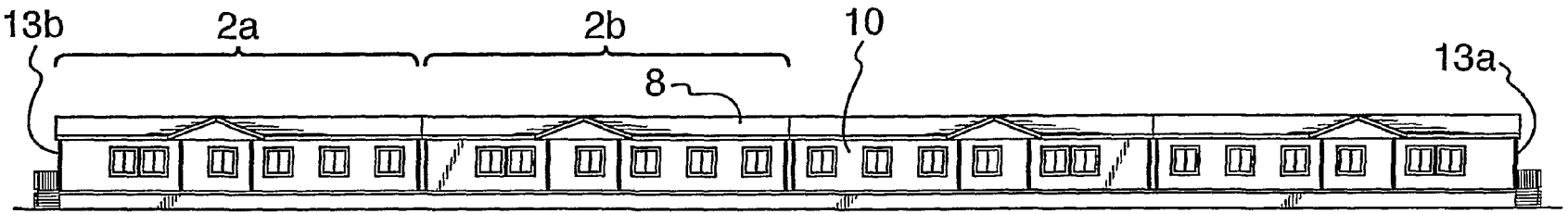
FIG. 1B is a front elevation of the complex of FIG. 1A.
Figure 1C:
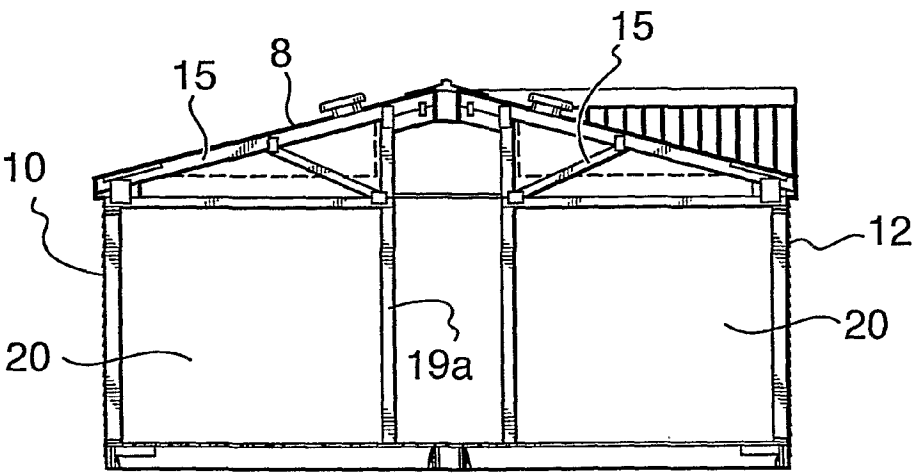
FIG. 1C is a sectional view along line C-C through the structure of FIG. 1A (shown without furnishings)
Figure 1D:
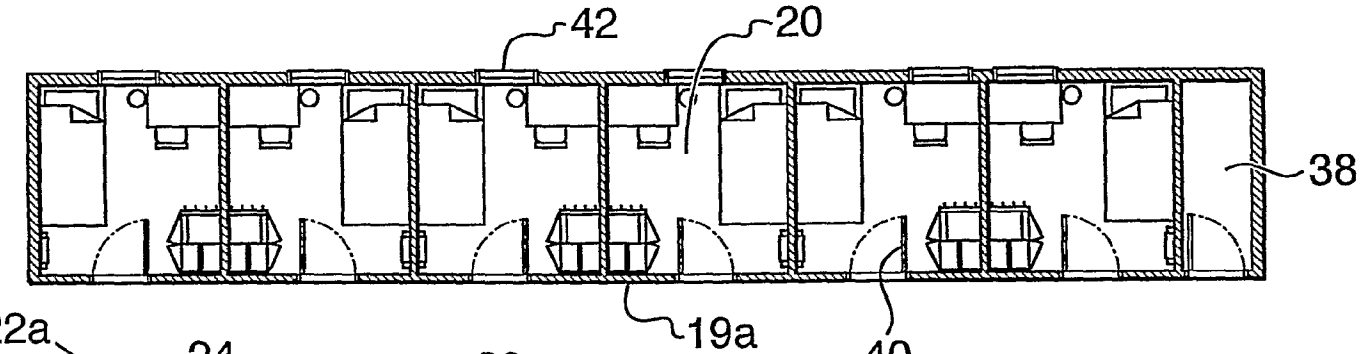
FIGS. 1D, 1E and 1F are plan views of three units useful in the construction of modules for incorporation into a worker housing complex.
Figure 1E:
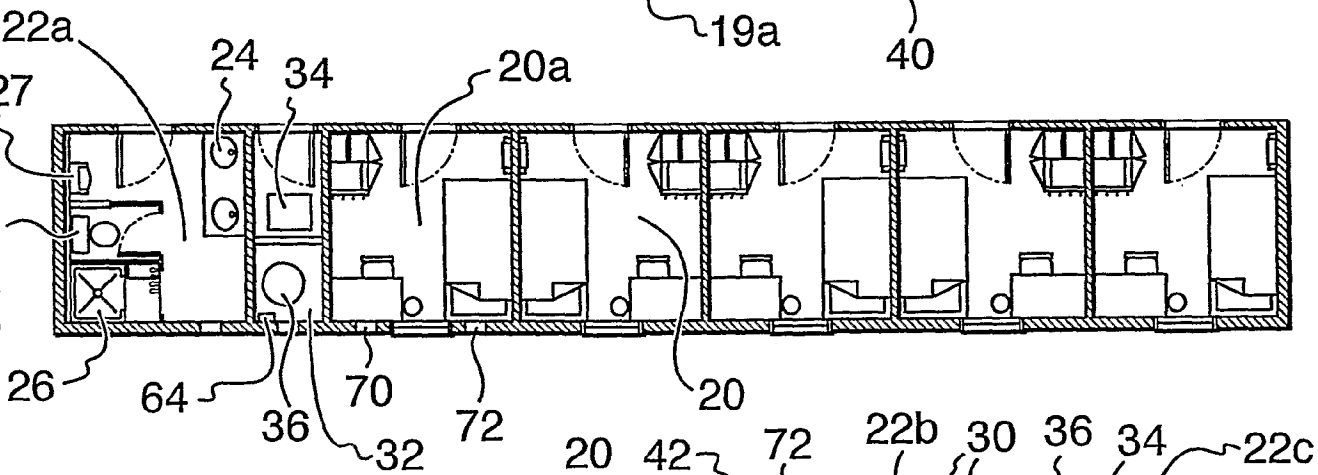
Figure 1F:
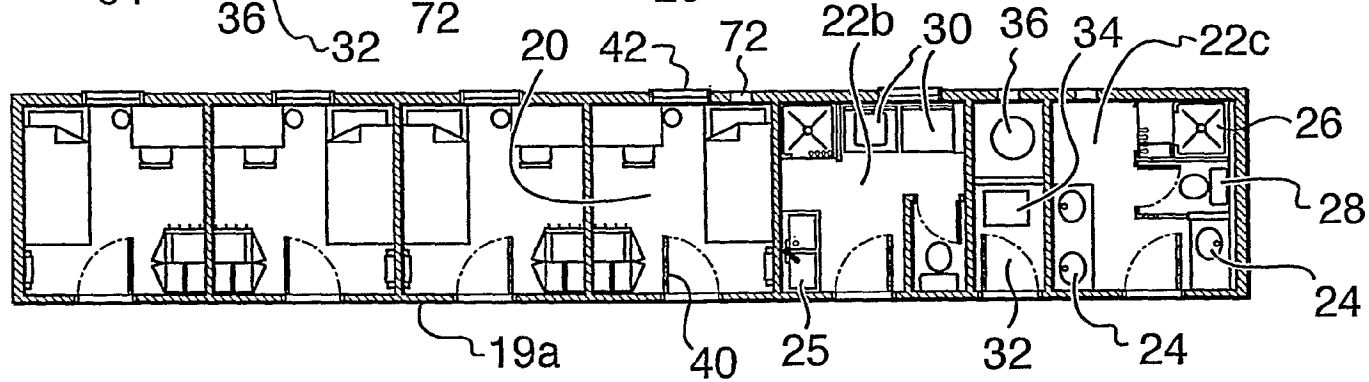
Figure 1G:
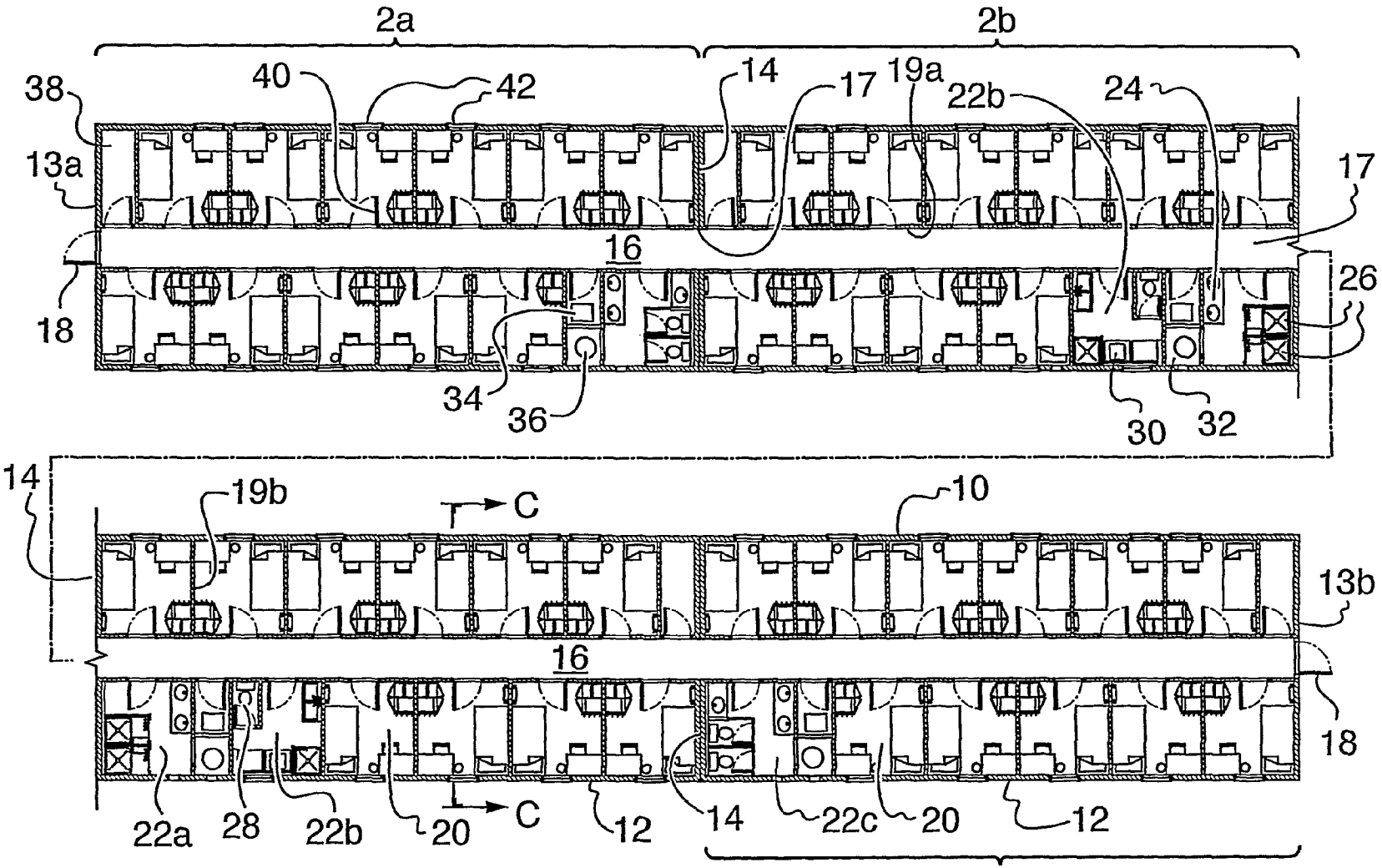
FIG. 1G is another plan view of a worker housing complex according to the present invention including units suitable for reuse in at least one secondary application.
Figure 2A:
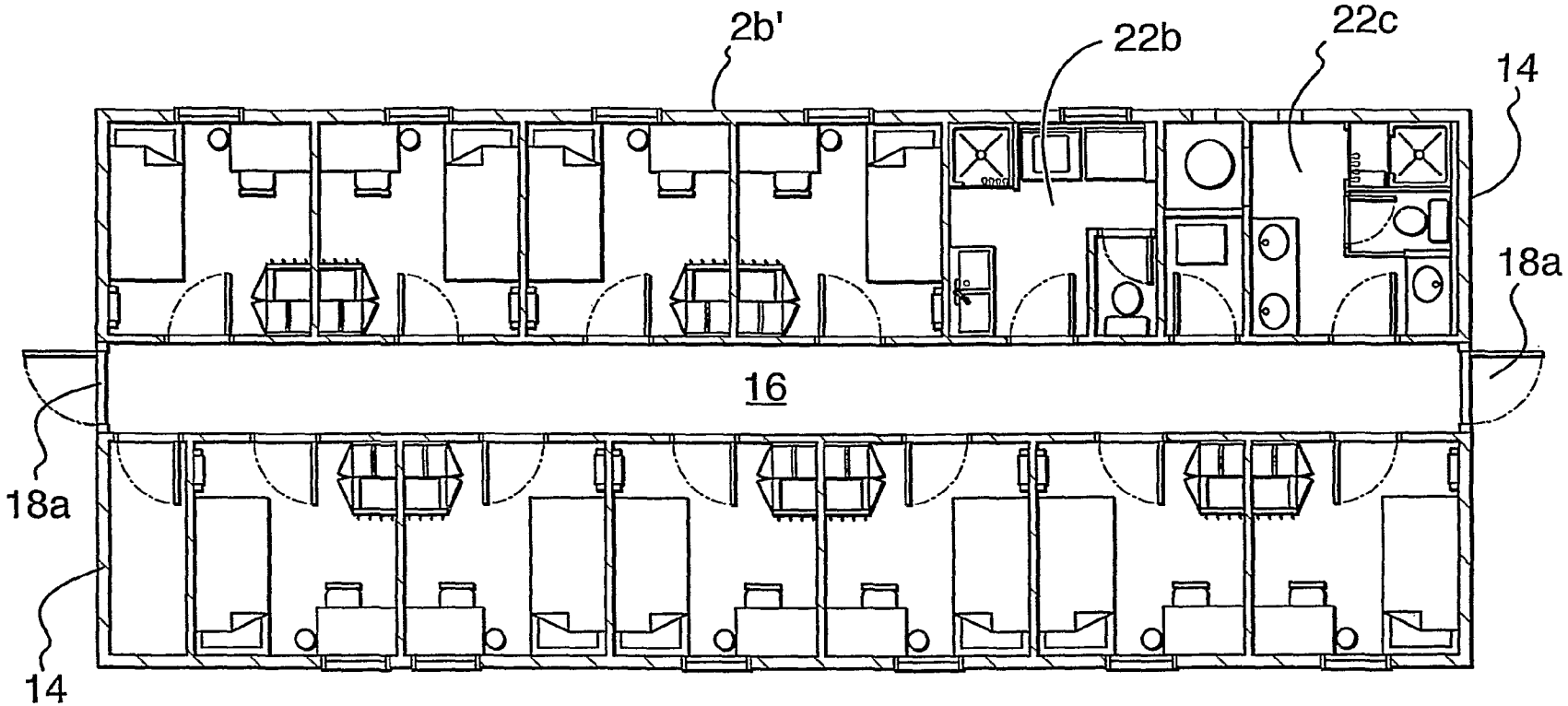
FIG. 2A is a plan view of a structure according to the present invention in a form suitable for use as a residence.
Figure 2B:
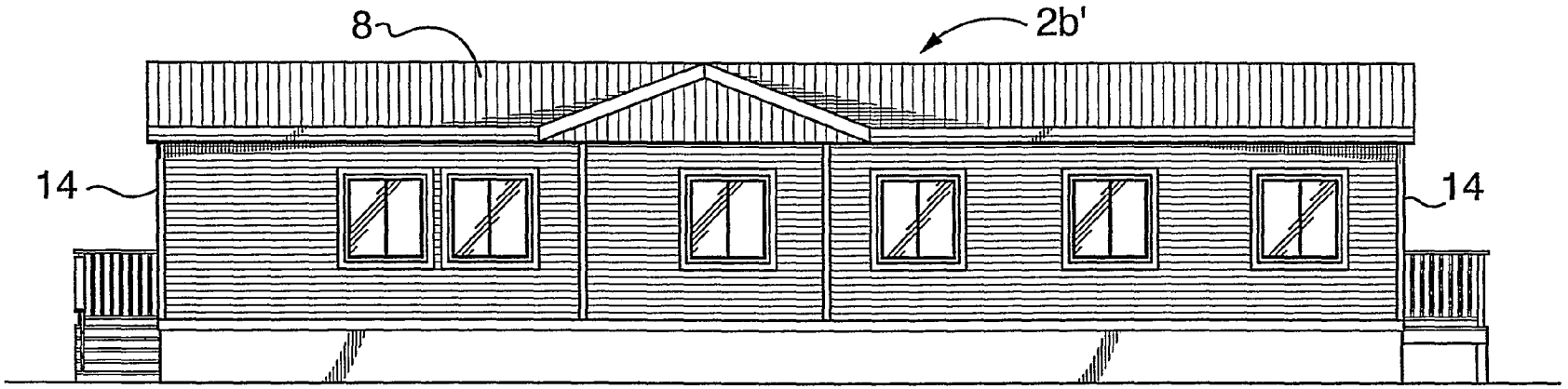
FIG. 2B is a front elevation of the structure of FIG. 2A.
Figure 2C:
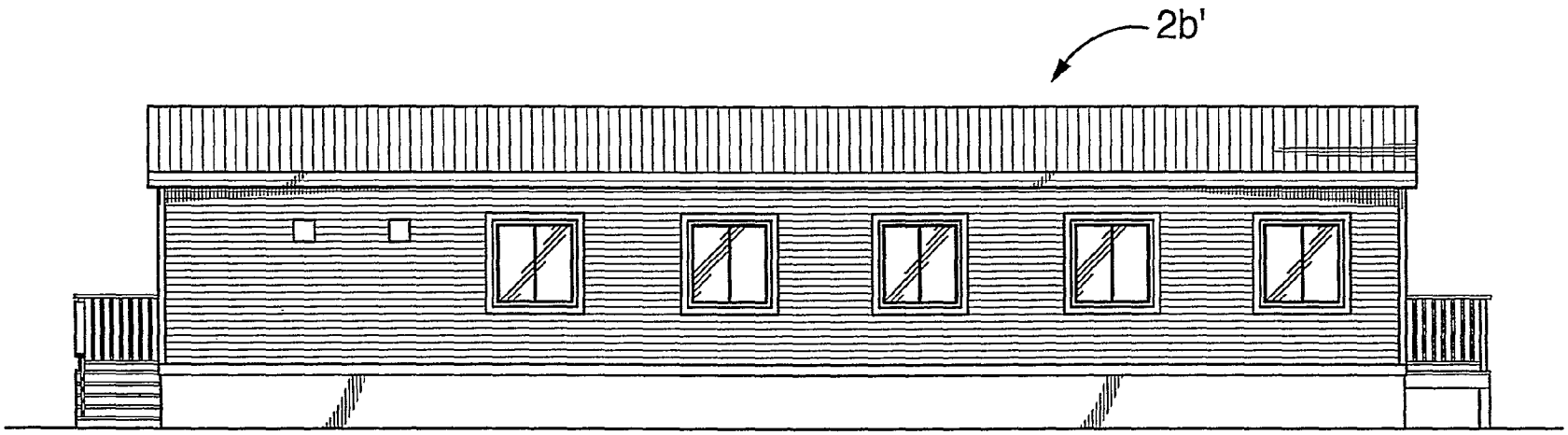
FIG. 2C is a rear elevation of the structure of FIG. 2A.

Referring to FIG. 1, there is shown a complex for use in housing a work force. The complex is formed of a plurality of modules 2*a*, 2*b* joined together in end to end configuration. In the illustrated embodiment, the complex is formed of four modules. An example of a single module 2*b'* in stand alone configuration as a dormitory-style residence is shown in FIG. 2. The modules each are formed from a pair of units, the units can vary depending on the complex requirements. Three example units are shown in plan in FIGS. 1D to 1F.

Figure 3A:
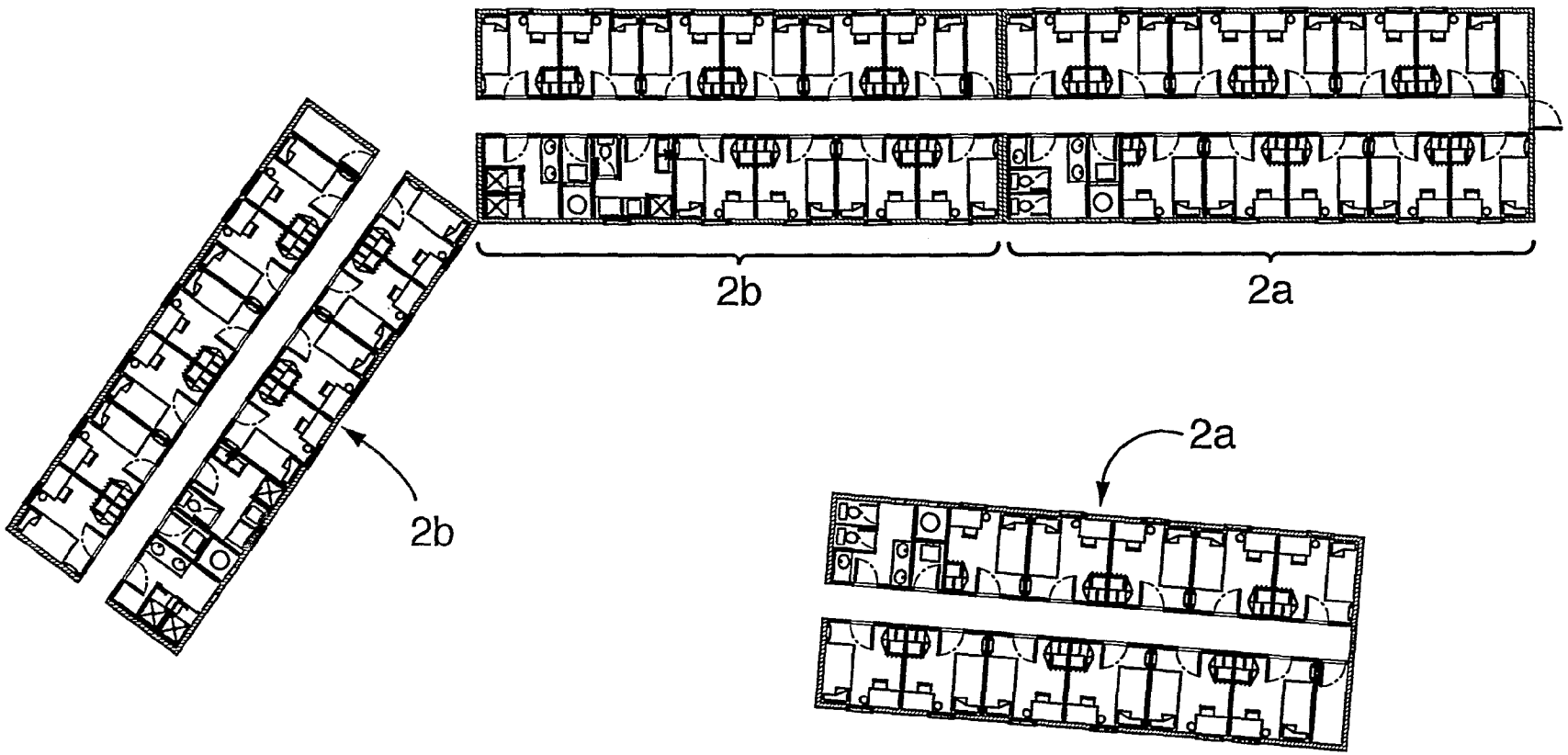
FIG. 3A is a plan view of the complex of FIG. 1A shown in the process of being disassembled for reuse.
Figure 5:
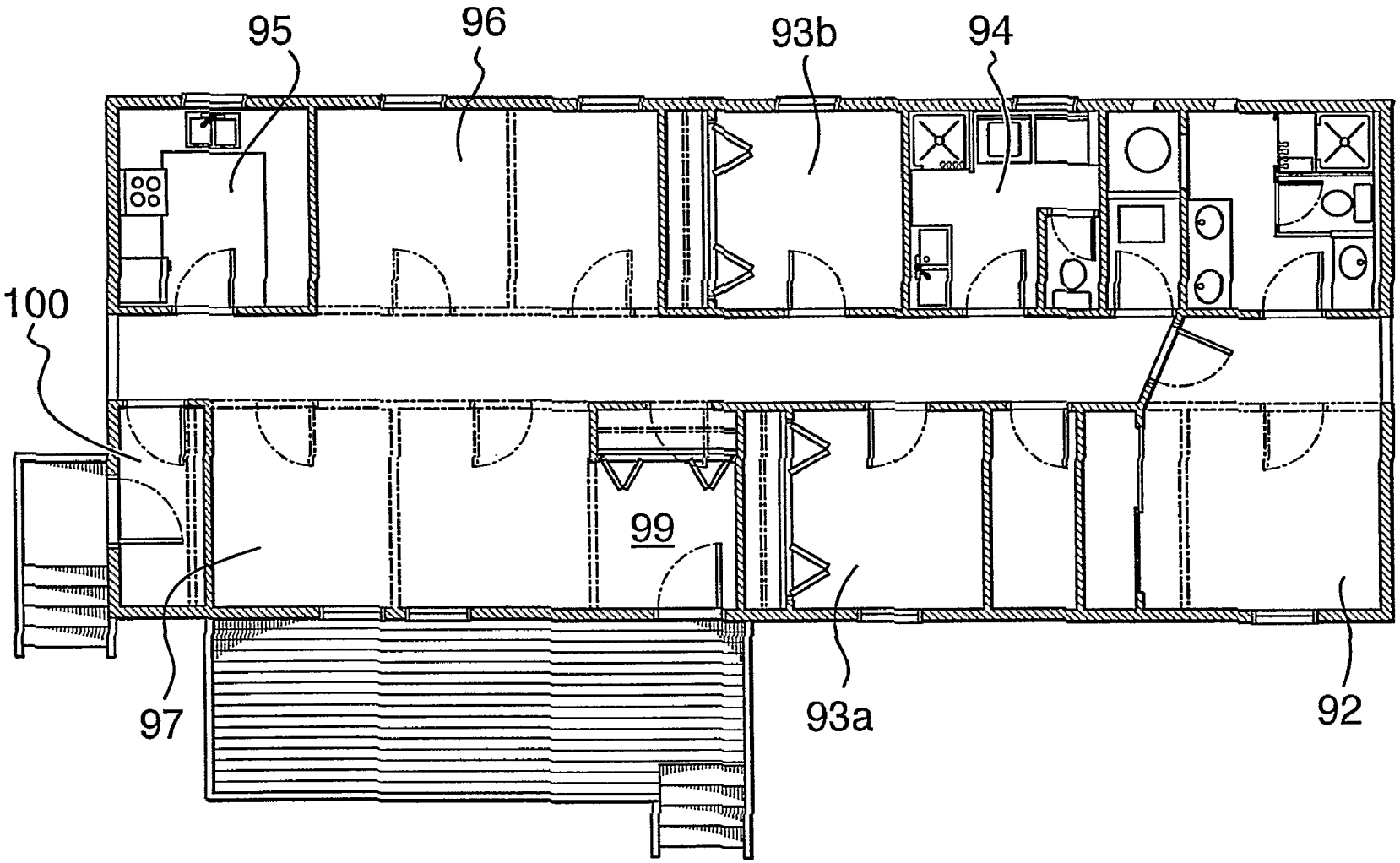
FIG. 5 is another plan view of a structure reconfigured to a form suitable for use as a single family house.

The complex, once its usefulness as work force housing is complete, can be reused in another site as workforce housing or in the same site or another site for various secondary applications. One secondary application may be as a smaller worker housing module or residence for institutional or detention purposes to accommodate fewer persons than the original complex. For example, a secondary application may include using only one module from the original complex as a stand alone structure for worker, detentional or institutional dormitory-style housing, as shown in FIG. 2. To do so, the complex can be separated as shown in FIG. 3. Another secondary application may be for family housing wherein the complex is separated and converted to form, for example, detached or semi-detached single family houses. Embodiments of detached houses are shown in FIGS. 4 and 5. Again, such decomplexing can be achieved, for example, by methods as shown in FIG. 3.

The complex of the present invention may be constructed both with consideration as to the requirements for the complex to be used as worker housing and to a proposed end use for the entirety of the complex or at least some of its modules or units. In the complex illustrated in FIG. 1A, the modules of the complex are intended for end use as family housing. As such, each unit may be constructed with consideration both to the requirements of worker housing and to the requirements for conversion to family housing. This may be useful for the structure's systems that are difficult or very costly to access or modify after construction.

The complex of FIG. 1 is formed of eight units that together form four modules, for example, 2*a*, 2*b*. The complex includes a roof 8 and four exterior facing walls including a front wall 10, a rear wall 12 and two end walls 13*a*, 13*b*.

It is noted that because the complex is formed of a plurality of units, each of front, rear and end walls 10, 12, 13*a*, 13*b* and roof 8 are formed by the combination of these structures on the individual units. The roof and exterior facing walls are insulated and clad for exterior exposure. In the illustrated embodiment, each module of the complex may be selected to be separable, in a secondary application, from the other modules of the complex. Thus, the units may have walls 14 that are not open to the exterior when the modules are assembled in the complex but are insulated and clad for exterior exposure so that the modules can be separated from the complex and used in a stand alone configuration. The cladding for walls 10, 12, 13*a*, 13*b*, 14 and roof 8 can be of various materials such as of metal sheeting, membrane roofing, etc. It is desirable to select materials rated for safe use, for example with respect to fire ratings, in high density installations such as work camps. However, where the secondary application of the complex is intended to be for family housing, as illustrated, it is desirable to clad the modules of the complex in materials and in a manner normally associated with residential buildings such as metal, polymeric or cement-based siding and metal or asphalt roofing. In one embodiment, for example, fiber-filled concrete siding materials such as that available as Hardiplank™ (James Hardie Building Products Inc., California) may be used, that has a fire rating useful for high density installations, but also has an appearance accepted for normal residential use.

When constructing a unit to be used for a secondary use as family housing, consideration may be given to the rating of insulation used in the unit such that it preferably meets the insulation standards for the secondary application, as it will be appreciated, that it is very expensive to modify insulation once a unit is constructed.

In the illustrated complex, intended for reuse as residential housing, the units of the complex may be formed with a truss roof 15 configuration such that when two units are constructed into a module, the overall roof will be peaked (FIG. 1C), thereby, more closely resembling a conventional residential dwelling. In addition, a dormer may be formed on each module to enhance the outer appearance of the module and, thereby, enhance their acceptance as residential dwellings. Of course, these exterior features are optional, but can be added to enhance the reuse of modules for family housing. These exterior features could be removed or further exterior features could be added such as, for example, some enlarged windows or exterior decorative lighting fixtures. It will be appreciated, however, that in the form of the units intended for use in work housing, regardless of their end use, it may not be desirable to overly restrict the usefulness, transportability, for example with respect to outer dimensions or weight, or construction of the units into worker housing complexes. As an example, in many jurisdictions a unit may not exceed 12'6" wide, 60' long and 13' high and weigh less than 35,000 lbs in order to be within economic transportation constraints (i.e. not requiring a permit).

The interior of the complex may include a hallway 16 extending the full length of the complex between the end walls 13*a*, 13*b*. In particular, openings 17 may be formed in walls 14 and are aligned between the modules to provide open passage between the modules. A plurality of interior walls 19*a* in each module form a hallway in each module between the openings 17 at each end thereof and hallway 16 may be formed of these connected module hallways and may extend through the plurality of modules forming the complex. An exterior doorway 18 on each end wall 13*a*, 13*b*, may provide access to the hallway from outside the complex.

Further interior walls 19*b* may define a plurality of rooms in each module. From hallway 16, access may be provided to the plurality of rooms intended to be used by work persons including a plurality of bedrooms 20 and washrooms 22*a*, 22*b*, 22*c* including lavatory sinks 24, mop sinks/laundry tubs 25, showers 26, urinals 27 and toilets 28. Some washrooms may also include clothes washing appliances 30 (i.e. clothes washers and dryers). Rooms 32 may also be provided for enclosing mechanical systems such as furnaces 34 and hot water heaters 36. Storage rooms 38 and other rooms, such as recreation rooms (not shown) and kitchens (not shown), can also be included in the complex, as desired. The number and size of the rooms in each complex and the purpose of these rooms may be decided based on the various requirements of the job site and requirements set by the entity responsible for the project. In the illustrated embodiment, the complex is selected to house 42 persons, each with their own bedroom 20. Each bedroom is about 80 $ft^2$ and includes room for a bed, storage closet and desk. Each module in the illustrated complex is arranged to house at least 10 persons.

Interior doors 40 are provided where appropriate. A plurality of windows 42 are provided, especially in bedrooms 20 and some washrooms, for ventilation, natural lighting and for emergency escape.

The number of washing fixtures 24, 25, 26, urinals 27, toilets 28 and clothes washing facilities 30 in the complex may be selected to support the number of people intended to be accommodated in the complex. Generally, as an example, a complex for housing 42 workers may require: six toilets, three urinals, six showers, ten lavatories, two large sinks (i.e. mop sinks or laundry tubs), two of each clothes washers and dryers and the power and plumbing connections to service these fixtures. In addition, the total output of the furnaces and the hot water heaters is selected to service the entire complex. However, rather than these plumbing and heating fixtures being grouped in the complex, they may be distributed through the plurality of modules. In particular, the complex may be constructed such that all of the modules of the complex that are intended to be used on their own in the proposed secondary application, may have a plumbed-in water supply and a heat source. Thus, in some complexes such as the one shown, each module may have its own plumbing and heat source, while in other complexes only selected modules may have washroom and heat facilities with other modules in that complex being serviced through the facilities in the modules having washroom and heat facilities. Generally, however, it is desirable that the complex be constructed with at least 50% of the units including plumbing connections so that they can be distributed throughout the complex and then distributed throughout separated modules in the secondary application.

Generally, worker housing units used to form worker housing complexes may not contain a kitchen area, it being preferred instead that there be large centralized messing facilities to serve the workers. However, to be adapted for reuse as a residential house in a secondary application, a room in a unit may be needed which is convertible into a kitchen. To facilitate conversion, it is desirable that a room in the unit be selected for accepting the kitchen, since this will permit some preparation of this room at the time of unit construction, as by providing some service rough-ins, etc. It is also desirable, although not necessary that the layout of the kitchen in the secondary application be considered even when constructing the original unit so that placement of terminal boxes and roughed-in services can be considered.

As will be appreciated, it is convenient, although not necessary, to select a bedroom adjacent a washroom to be convertible to a kitchen. It is therefore, useful to create a plumbing wall 44 through which access can be made to the existing plumbing serving an existing washroom, for example 22*b*. While in the illustrated embodiment, there are no plumbing rough-ins in the bedroom intended for conversion to a kitchen, a capped port or junction on the existing plumbing venting system can be provided to facilitate connection of the required kitchen plumbing venting. However, if desired, plumbing rough-ins can be provided at the time of unit construction to further facilitate kitchen installation during reuse. Such rough-ins can be exposed within the bedroom in capped or operable form (a small lavatory) or the rough-ins can be hidden behind a wall panel but accessible during conversion by forming an opening through or removing the wall panel.

The room intended for the kitchen may also in the secondary application require an electrical system suitable for supporting kitchen requirements. Some of these electrical system requirements can be roughed-in at the time of unit construction. For example, a kitchen may require a higher rating power supply for the range, a ventilation exhaust fan, greater numbers of electrical outlets and electrical outlets spaced from the floor a distance that is suitable for positioning a countertop thereunder. Thus, to facilitate conversion, a conduit 46 for accepting the higher rating electrical cable can be provided between the unit's power panel 64 and the bedroom, for example 20*a*, intended for conversion to a kitchen. Alternately, the higher rating power cable can be installed between the bedroom and the power panel. In addition, or alternately greater numbers of outlets can be installed in the bedroom and/or the outlets can be installed at greater distances from the floor permitting the installation of a countertop therebelow without moving the outlet. An electrical rough-in can be provided in an exterior wall to permit installation of a ventilation fan. In one embodiment, a knock out portion 72 is also framed into the exterior wall to facilitate installation of the ventilation fan.

To facilitate other aspects of conversion, the units can be constructed to include features such as removable and/or reusable wall partitions and fixtures such as toilets. For example, toilet and shower installation methods may provide durable, but removable, connections.

While the complex may appear to be more complicated than previous worker housing complexes due to the decentralized wash facilities and water heating and interior heating units, construction of the units for the complex may be facilitated by use of duplicate units. In particular, only three units, shown in FIGS. 1D to 1F, were used to form the complex as shown in FIG. 1A. To further facilitate construction, some units such as that shown in FIG. 1D may contain no plumbing or furnaces and in units having plumbing/furnace systems, these systems may tend to be grouped together to simplify unit fabrication and module construction requirements.

To construct a worker housing complex according to the present invention, a plan can be formulated based on one or more of the work housing site environment, the terrain, the level of comfort desired for the workmen, the logistics required to get the units and supplies to the work site, the length of the project, the requirements of labor guilds, the local Building Codes, and/or the financial constraints set by the entity responsible for the cost of construction of the total project. The plan for the worker housing complex may also be formulated with consideration as to a proposed secondary application for the worker housing complex once its usefulness as worker housing is complete. This may include consideration as to local Building Codes, proposed site conditions, sewer, water supply, fuel supply, and power facilities, etc. for the secondary application.

Based on the plan, units may be constructed or selected from standard units which are suitable to construct the complex. The units may be constructed with consideration as to the requirements or additional desired features of insulation, exterior features, electrical, plumbing and mechanical systems, etc., as set out above. The units may then transported to the work housing installation site and connected to form the complex.

Each unit may be delivered to the assembly location with a majority of the structure and its amenities prefabricated. The method of delivery will vary depending on the logistical constraints associated with the particular assembly location. The most common method of delivery will be by tractor/trailer.

In the worker housing complex configuration, units may be assembled to form a complex by positioning each unit on a foundation structure 47 configured to suit the final complex. Utility services (electricity, portable water, sewer and possibly gas/oil fuel) may generally be provided at the edge of the complex imprint at pre-determined points. The foundation may provide either continuous or intermittent support along the longitudinal edges of each unit. Foundation configuration varies with respect to materials readily available, engineering requirements, and the methods that can be adopted to position each unit into the predetermined complex configuration. In general, the foundation members may be spaced to accommodate vertical lift only capability (fork-lift or jack) for the transfer with the unit positioned by the tractor/trailer. Micro positioning may be done with various tools offering the required mechanical advantage to set each unit into its desired position. Other types of spacing may require use of transfer methods requiring significant horizontal as well as vertical movement (i.e. lifting and positioning off the transporter by overhead crane) and specific lifting points may be provided for this movement. Attachment of the unit to the foundation and the anchorage requirements may be determined to satisfy the environmental conditions for the complex site. As will be appreciated worker camps can be constructed with complexes formed in many ways. For example, in some camps, complexes are formed as multilevel structures.

As units are positioned, transport covers are removed and the units are interconnected and secured to the foundation, if required, to form a structurally integral and weather tight complex. Connection points may be located where adjacent units abut to each other and connecting materials may be applied to both the exterior and the interior to obtain the required structural integrity and finish. The sequence of interconnection operations can vary but closure of the exterior envelope is a priority to weather tight the envelope and provide structural integrity to the assembled components. Preferably, the interconnecting methods used are such that fasteners can be removed and, with a few exceptions, the complexing materials can be reused for the next installation. Utility distribution (sewer, water, gas and electricity) may be above or below ground under the complex from the predetermined central point. Each unit (if applicable) may have one or more predetermined connection points to the central system or to the corresponding service in an adjacent unit and once all connections are made, the complex may be totally serviced.

Figure 6:
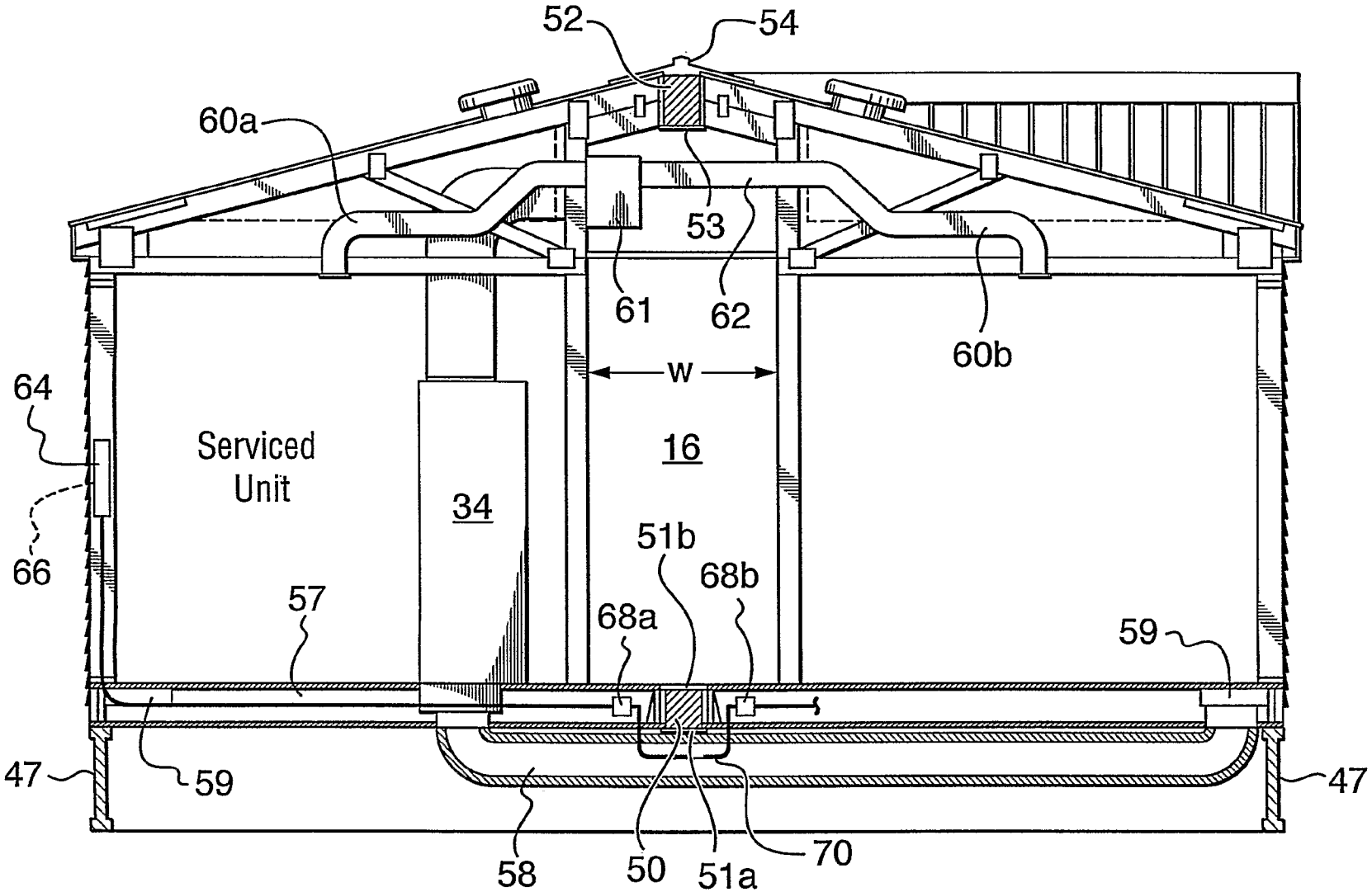
FIG. 6 is a sectional view through a module illustrating some of the complexing features.

With reference to FIG. 6, complexing may require installation of materials to bridge gaps between adjacent units. Gap filling materials can include, for example: a floor plug including a plug 50 of insulation capped on either side by plywood 51*a*, 51*b* and a roof plug disposed in the hallway 16, the roof plug including a plug 52 of insulation attached to a interior panel board 53 and roof flashing 54 disposed thereover. Other gap finishing means are installed, such as wall plugs for installation at openings 17 between walls 14, the wall plug including a plug of insulation attached to a interior finish panel board, exterior wall gap closures, soffit connectors, roof flashing, etc. Since reuse for a secondary application is intended, it is desirable to use reusable materials, such as wall panel inserts installed by use of removable fasteners, such as screws, rather than permanent materials such as tapes, plaster, etc.

The width of the floor and roof plugs are selected to accommodate the space required to provide the appropriate width w in hallway 16, as will usually be established by Building Codes. Likewise, wall gap closures may span the distance between adjacent units.

Services such as water, sewer, and fuel (gas or oil) may generally be limited to use in one of two facing units, but electrical and HVAC may be connected between the facing units to reduce infrastructure requirements. For example, furnace 34 may be provided in one unit to service both the unit in which it is installed and the unit facing it. Furnace 34 can be powered by electricity, fuel oil, natural gas, liquid propane gas, etc. Air conditioning and humidification can be added to the system using equipment compatible with the basic heat exchanger and may be distributed in the forced air duct work. Furnace 34 may feed to a first supply duct 57 in the serviced unit and a second supply duct 58 which feeds the facing unit and supplies air to individual headers 59 for each unit which in turn may having openings into each room. In addition, return air ducts 60*a*, 60*b* may extend from each room through the ceiling to a cross duct 61 for collection and return to the furnace. Ducts 60*b* may extend between the units and, therefore, may include inserts 62, which are installed during complexing. In particular, as is usual for worker housing each bedroom may have heated air and return air ducts opening thereto. Where the ducts extend beyond the transported structural envelope of a unit, as is illustrated by duct 58, this duct may be installed at the time of complexing rather than at the time of construction to reduce transport complications. While the major portion of the HVAC system can be installed at construction, inserts 62 and duct 58 may be connected once the units are installed on their foundation and may be disconnected/reconnected each time the units are relocated to another location. All pieces may be re-useable.

It is to be noted that the units may sometimes be provided with electrical supplementary heating systems, for example baseboard heaters in each bedroom.

With respect to electrical servicing, an electrical panel 64 can be provided on each unit or on one unit to be used in each structure of the secondary application (i.e. one unit of each two-unit module, as shown). During complexing, each electrical panel 64 may be connected to a main power supply, as indicated at 66.

In some embodiments, one main power panel may provided for each complex, which can be a separate panel or incorporated into the electrical panel for one of the units, which in turn connects to the electrical panels 64. Junction boxes 68*a*, 68*b* can be installed in the units for electrical interconnection 70 between the units, which is wired at complexing. Wiring to the various devices/outlets may emanate from the power panel with fusing to protect each circuit. All circuits feeding the facing module may pass thru the junction boxes 68*a*, 68*b*. The circuitry may be connected/disconnected and reconnected between the two junction boxes on each complexing/decomplexing and reinstallation.

Sanitary waste collection, which may include venting to the atmosphere, may be built-in for plumbing fixtures during construction of the worker housing units.

Each fixture (or group of fixtures) may have its waste outlet terminate at the underside of the floor to be connected to the central collection system once the individual units are set on their respective foundations. Configuration of the central collection system may vary from site to site.

During complexing all other services including, for example, portable water and fuel, which are built in at the factory for the required fixtures, may be connected to the main supplies at the work site. Each serviced unit can have its own service systems, but all serviced units in a complex may generally be connected into a main complex or job site system.

After a worker complex is no longer needed for worker housing, the units can be decomplexed and moved to another site for reuse as worker housing in a substantially similar complex. To move the complex to another site for reuse as worker housing in a substantially similar complex, a decomplexing procedure is used which is generally the reverse of the complexing procedure. If the complex is to be moved only a short distance it is desirable to move the units while they remain connected as at least a module 2*a*, as much as possible, as shown in FIG. 3. This can be done, for example, by use of a crane 56 and/or by use of a tractor/trailer with dual dollies 63 to remove the module from its foundation 47.

It is a particular advantage of the present invention, however, that the units of the complex can be converted for use in a secondary application which can be, for example, worker, institutional or detention housing in a different configuration than the original complex, or various forms of residential housing.

In one embodiment shown in FIG. 2, a module from a worker housing complex has been converted into a 10 person residence structure. When converting the 42 person workers housing complex, for example of FIG. 1A, into four 10 person residences, the connections to other modules with respect to water, sewer, electrical, etc. may be disconnected, gap closures at end walls 14 may be removed and end panels including exterior doors 18*a* may be fitted to close openings 17. Otherwise, the exterior envelope and interior walls/doors may remain "as built" from the factory. In the illustrated embodiment, the two modules that have adequate toilet, urinal, shower and sink provisions, modules 2*b* containing the units of FIG. 1F, can be used as stand alone residences, as is. However, each module 2*a* having the 5 Person Sleeper/Washcar (FIG. 1E) units may be converted to provide adequate services for 10 occupants. In particular, in each unit a bedroom 20*a* (FIG. 1E) may be converted to a washroom by removing the furnishings and installing the ablution, washing and shower equipment, as needed. This room conversion may be accomplished with very minor modifications to the electrical system. In particular, power sources 71 may be in strategically located terminal boxes with conductors leading back to the power panel 64 requiring connection only at each end to be put into service and plumbing waste systems may be connected into existing plumbing from washroom 22*a*. In particular, water may be supplied by extending service from that in an adjacent washroom 22*a*. Waste vents may connect above the ceiling to the existing system servicing the adjacent washroom through provisions, such as a capped junction, incorporated into the venting system during construction, without making additional penetrations through the weather proofing exterior (roof/walls etc.). Waste outlets can be inserted through the floor and tied into a common manifold with the adjacent washroom's waste collection system. Exhaust fans may be installed into preframed openings 72. Primary services, water, gas or other fuel and electricity may be identical and may require no changes other than adjusting for size of demand required and direct connection to a main supply.

In one embodiment shown in FIG. 4, a module from a worker housing complex has been converted into a detached residential family house. The conversion of a 42 person workers housing complex, for example of FIG. 1A, into four residential detached houses, may be accomplished with minor changes to the exterior envelopes and significant changes in the interior arrangements, for example, by removing, repositioning and deleting walls or portions thereof and/or deleting and adding fixtures, appliances and equipment. It is possible to reuse much of the structure and utility distribution system with only minor modification, offering significant economic benefits to the alternative of deploying workers housing to an area to man a construction project, removing it after the construction is completed, and providing separate housing for the families that will service the enterprise constructed on an ongoing basis.

With respect to the reuse procedure, the units or modules may be decomplexed by disconnecting the connections to other modules with respect to water, sewer, electrical, etc. and removing gap closures at end walls 14. Multi-level modules may be used as is or reconfigured as desired.

Figure 3B:
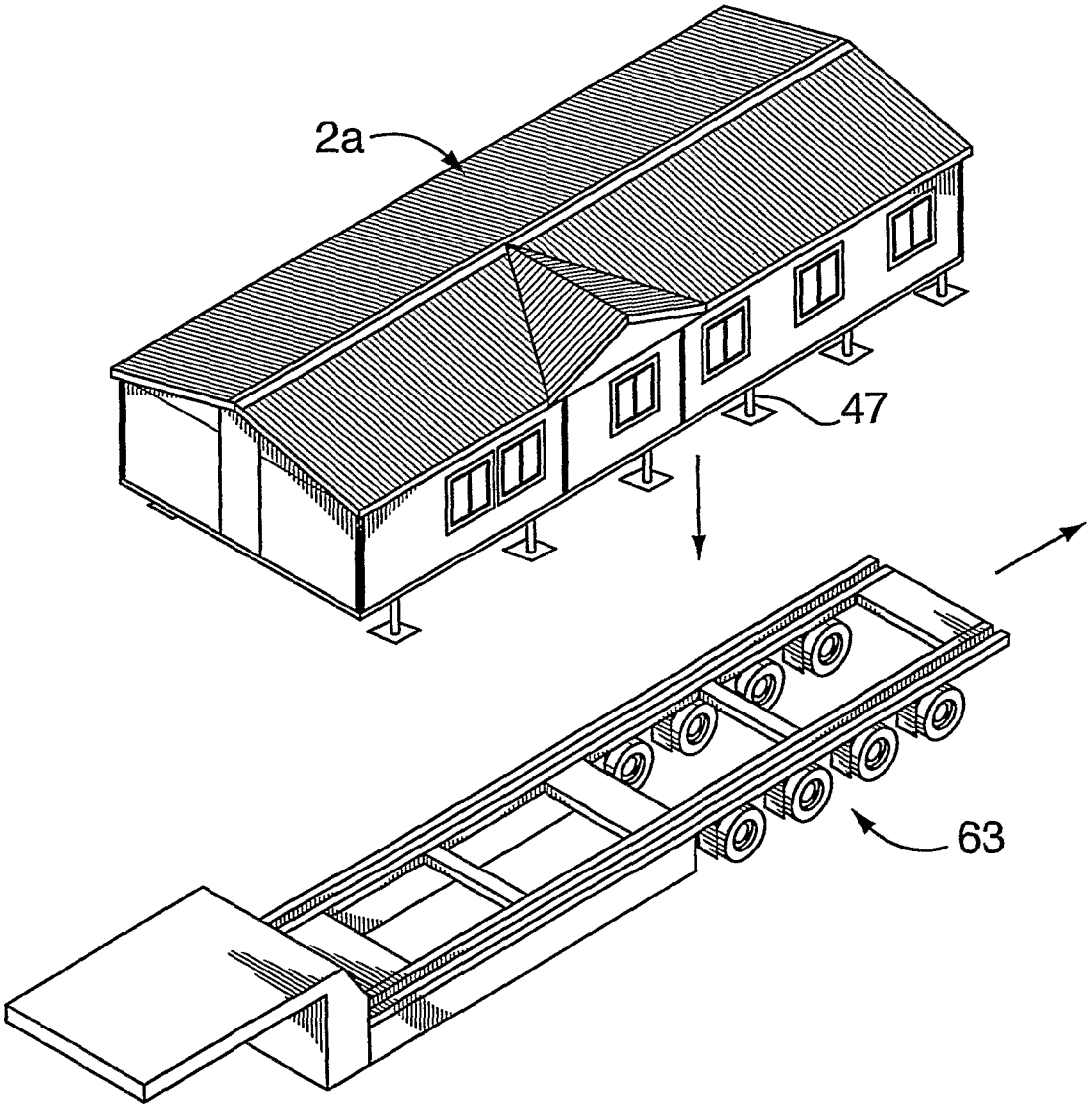
FIGS. 3B and 3C are perspective views showing a module being moved.
Figure 3C:
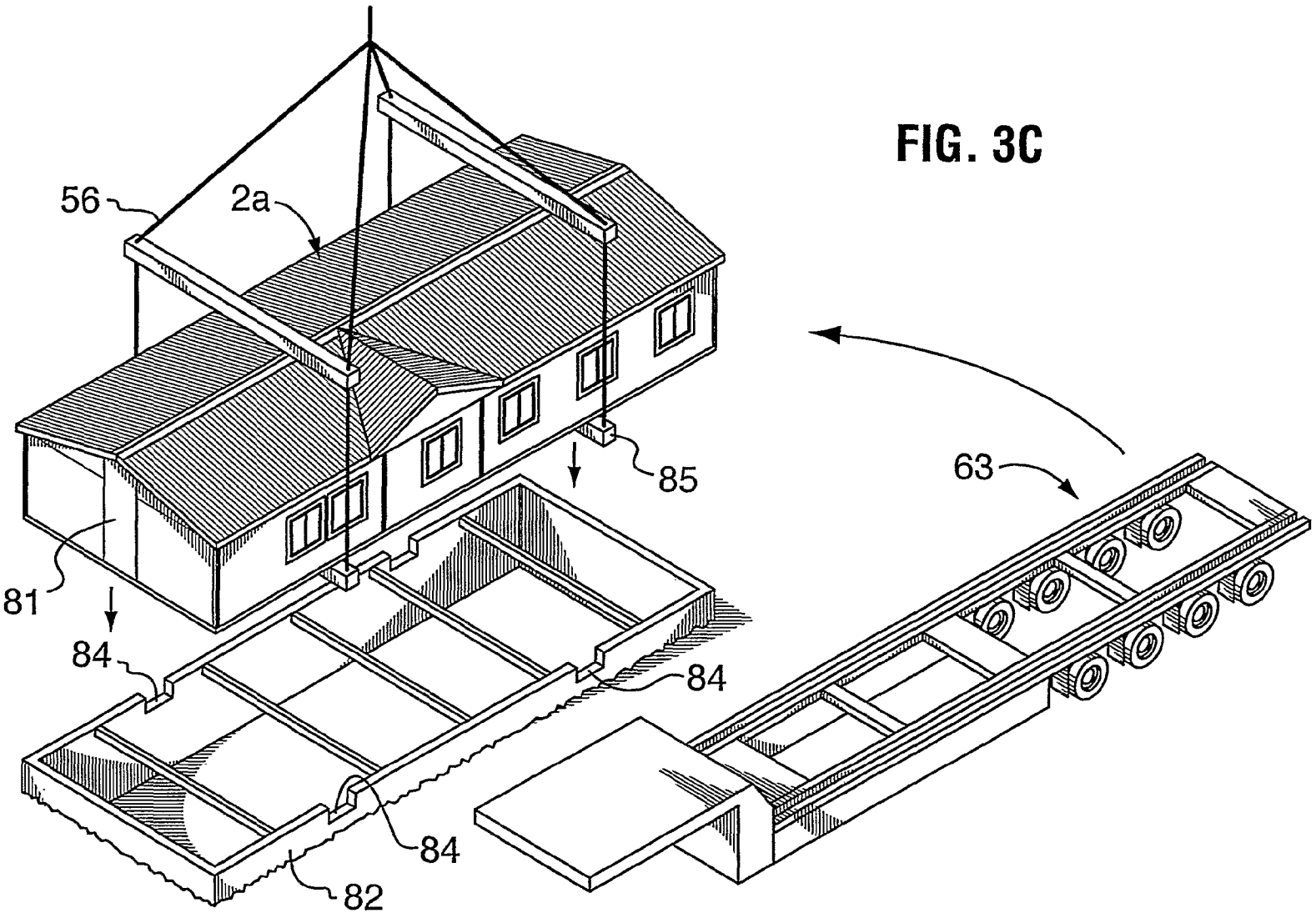
Figure 4A:
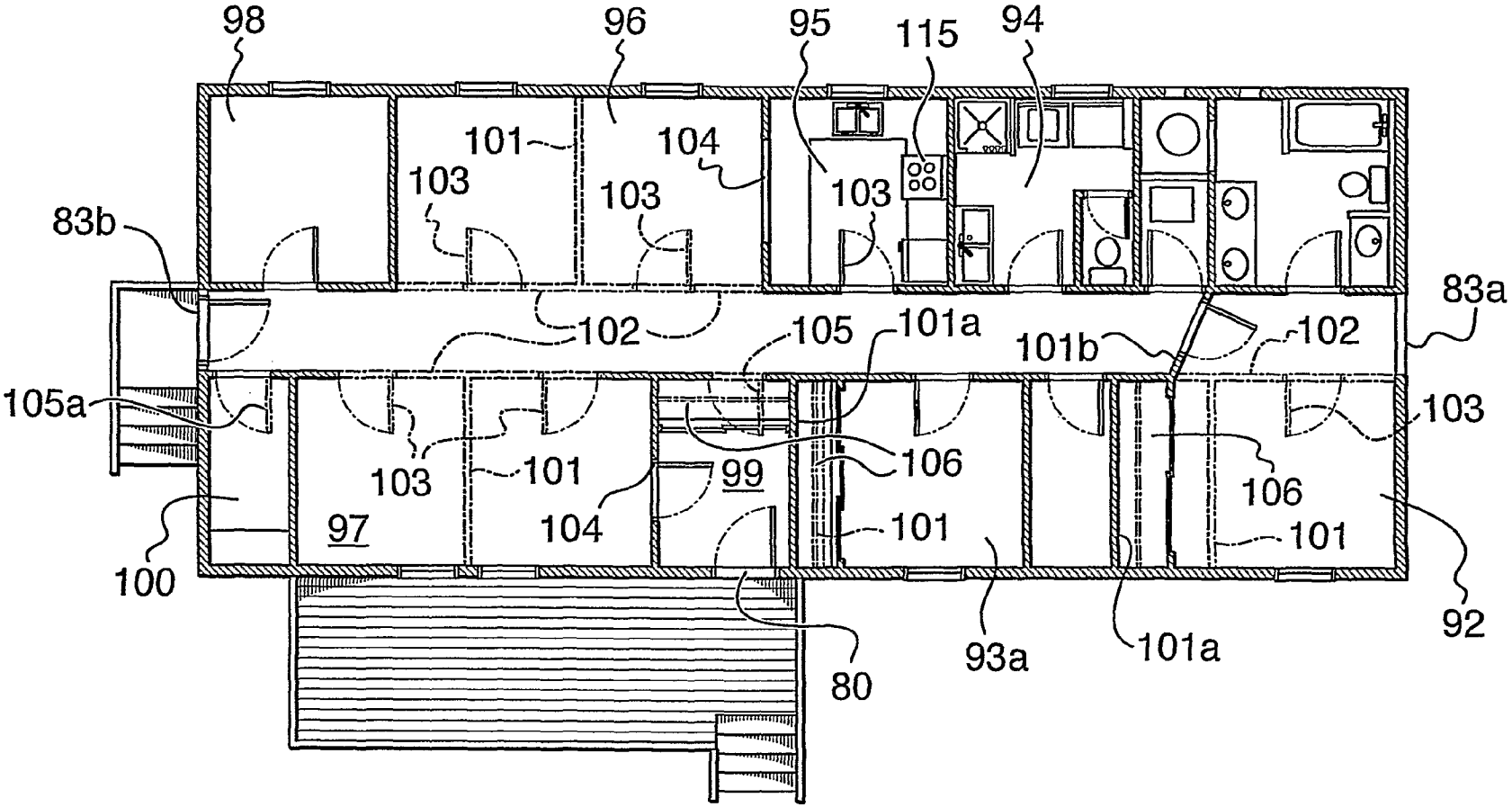
FIG. 4A is a plan view of the structure of FIG. 2A reconfigured to a form suitable for use as a single family house.
Figure 4D:
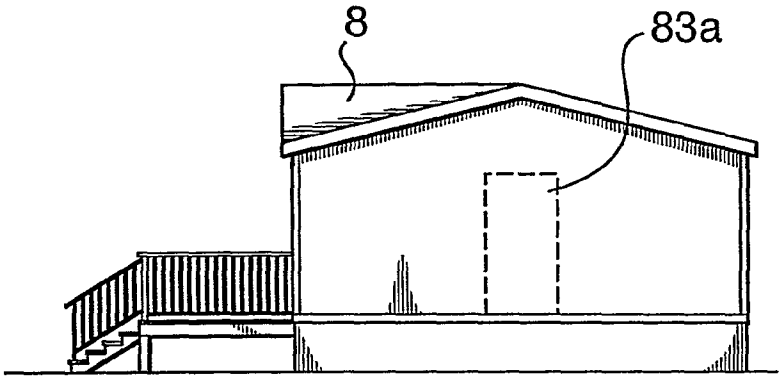
FIG. 4D is an opposite end elevation of the structure of FIG. 4A.
Figure 4B:
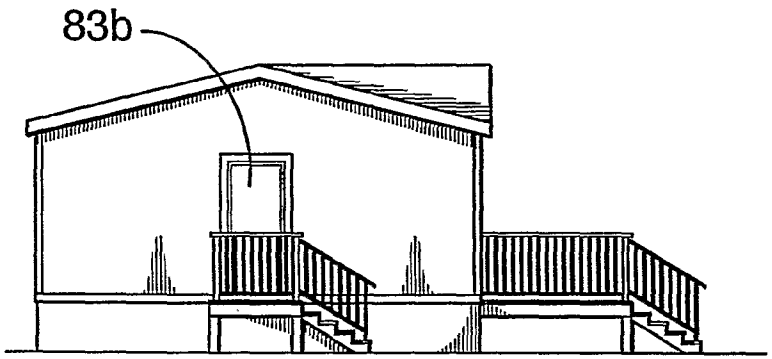
FIG. 4B is a end elevation of the structure of FIG. 4A.
Figure 4C:
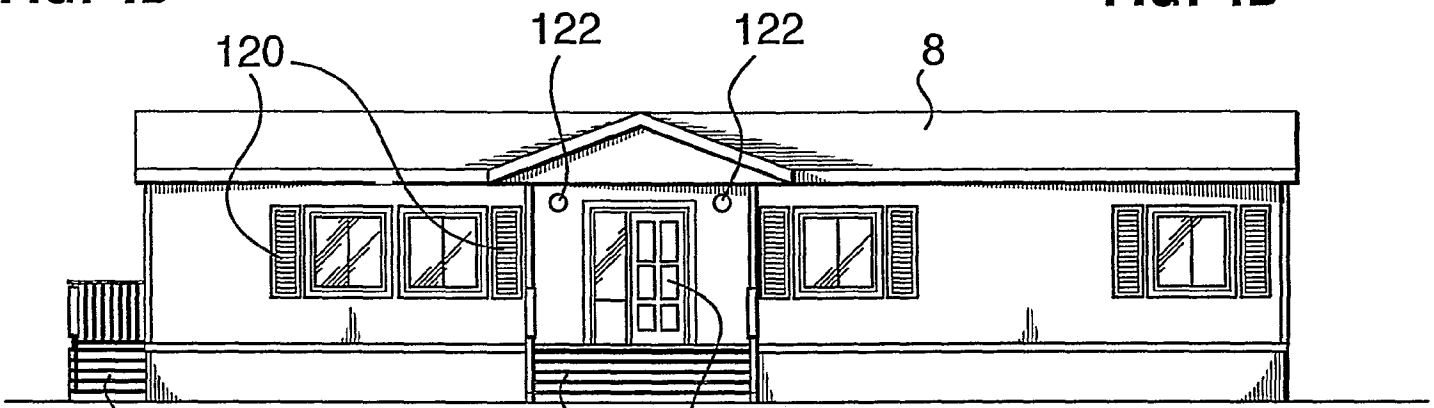
FIG. 4C is a front elevation of the structure of FIG. 4A.

If relocation is needed, various options are available In relocating two adjacent units as a one piece module, for example as shown in FIG. 3B, the opening 17 can be covered with a panel 81 and the exterior can remain intact, keeping the assembled units weather tight. A priority after relocation may be to complete the exterior closure in the final position by installing end closures and window closures, re-installing the roof and floor gap closures, etc.

Upon arrival at the site for the house, the module will be set on its foundation, which again can vary in form and method depending on terrain and owner's preferences. In some embodiments as shown in FIG. 3B, the foundation can form a full basement 82. In such a foundation, it may be useful to provide vertical recesses 84 for accommodating the structure lifting bars 85 (used with a crane apparatus 56), so that the module can be set down directly onto the foundation.

Thereafter, recesses 84 can be fitted with windows or doors, as desired. Of course in this arrangement, stairs or other access to the basement may be required.

In continued conversion of the module for the secondary application of the illustrated embodiment, one exterior window may be removed and the opening enlarged to accept a new entry door 80. Perimeter framing for door 80 can be provided in the unit, as constructed, if desired. End wall panels 83*a*, 83*b*, some including exterior doors or windows, may be fitted to close openings 17 and, thereby to complete the exterior envelope. Exterior siding materials can be sealed to replace exterior membrane materials missing or damaged after the initial use.

Interior modifications can be accomplished without major alterations, as the insulating envelope and structure supporting system may not be changed. In particular, in the illustrated embodiment of FIG. 4A, the worker module may be converted to a family house including a master suite 92, a bedroom 93, a bathroom and laundry room 94, a kitchen 95, an eating area 96, a living room 97, an extra room 98, a foyer 99 and a mud room 100.

The illustrated conversion may be accomplished by:

- removing four lateral partitions 101, two of which 101*a* are relocated;
- removing four sections of longitudinal walls 102 complete with six interior doors 103, two of which are re-used 103*a;*
- forming openings 104 through two partitions for kitchen/dining pass-thru and for access to foyer 99;
- removing one interior door 105 and closing the opening;
- adding closets 106 including sliding closet doors, shelving and rods for the bedrooms 92, 93 and for the foyer;
- adding a short partition 101*b* to enclose the master bedroom 92;
- removing an interior door 105*a* to provide unrestricted access to mud room 100;
- a washroom modifications depend on the type of sleeper/washcar which was included in the module to be converted used and the procedure is described hereinbelow; and
- adding kitchen cabinets, shelving modules and kitchen appliances (i.e. range 115) completes the transformation.

Interior completion and finishing of the walls, wall openings and ceilings may include inserting materials to bridge gaps and to cover exposed framing, filling them flush and finishing to suit the interior decor selected for the structure.

The scope of work required for re-finishing floors will depend upon the expectations of the end user as the initial coverings can be repaired, joined to matching materials, removed, replaced or covered up. It may be desirable, for example, to add new floor coverings to all enclosed spaces that have increased in area, i.e. living room, dining room, master bedroom and the access corridor.

Each unit may be pre-wired for electrical distribution when it is initially manufactured. This may include provisions for services that will not be used in the worker housing complex but will be required in the residential housing configuration. These provisions may include terminal boxes with blank access covers and conduit/wiring (i.e. for the range 115) back to the appropriate junction box 68 and/or power panel 64.

With respect to the HVAC system, manipulation may be required for ducts extending outside the structural envelope, such as ducts extending under the structure.

When converting worker housing units to family residences, the internal water distribution may be extended to service the kitchen area and fixtures may be changed out with minor modifications to the distribution systems to make the specific connections, as desired. In all cases, the primary distribution may remain the same and can be used in the different roles without modification.

With respect to sanitary waste collection, changing and adding equipment to obtain residential housing may require additional waste drainage for the new items which can be stubbed thru the floor and connected to a single point under the floor. The initial waste venting system provided in the worker housing complex may include provisions to be extended for the secondary uses as a family residence without making additional penetrations through the weather proofing exterior (roof/walls etc.).

Once the module is converted for use as a residential house, exterior features such as for example, shutters 120, exterior decorative lights 122 and/or porches, decks or landings 124 could be added to further enhance the appearance of the house.

Referring to FIG. 5, another family house is shown which has been produced by conversion from a worker housing module separated from a worker housing complex such as that shown in FIG. 1A. In this particular example, the house includes a master suite 92, two bedrooms 93*a*, 93*b*, a bathroom 94, a kitchen 95, an eating area 96, a living room 97, an extra room 98, a foyer 99 and a mud room 100. It will be appreciated that other room selections and layouts may be useful.

In yet another embodiment, a smaller family residence may be desirable. In such an embodiment, a complex may be constructed using modules smaller than those illustrated in FIG. 1A. For example, where the illustrated modules include space for about 6.5 9'×9' bedrooms to extend from end to end, another module may provide space for 5 or 6 such bedrooms along that length. In some embodiments, it may be useful to incorporate furnaces, etc, into washrooms or other solutions to reduce the overall square footage of a module. Such a module may be converted into a residence, for example, including only one or two bedrooms. Such a residence, being smaller than those shown in FIGS. 4 and 5, may be more desirable in some situations.

In one embodiment, it may be useful to provide a kit for use in the conversion of a module to its secondary purpose. This may be particularly useful where modules are used to form residential houses. The kit may include, for example, any of all of plans, kitchen and bathroom cabinetry, exterior decorative accessories (shutters, etc.), a bathtub, closet hardware, etc. Such a kit may facilitate conversion of a module to its intended secondary use.

Of course, a 42 person complex could be reused in various ways and need not all be used as only dormitory-like residences or single family homes, but can be reused in whole or in part as a combination thereof or in other configurations.

It will be apparent that many other changes may be made to the illustrative embodiments, while falling within the scope of the invention and it is intended that all such changes be covered by the claims appended hereto.

The embodiments of the invention in which an exclusive property or privilege is claimed are defined as follows:

1. A method for providing residential housing comprising:

(a) employing a worker housing complex including a first module and an adjacent module, the worker housing complex constructed by a process including:

(i) reviewing any requirements of the worker housing complex to be constructed;

(ii) considering a secondary use as residential housing for the first module and the adjacent module after use in the worker housing complex;

(iii) planning the worker housing complex based on the requirements;

(iv) constructing the first module and the adjacent module to form the planned worker housing complex, each of the first module and the adjacent module including a plurality of interior partitions forming on one level at least five bedrooms, a hallway extending a full length of the module and providing access to all of the at least five bedrooms, a plumbing room accessed from the hallway and including a plumbed-in, operational water supply and a sanitary liquid waste disposal piping system, and an access point in the hallway for interior access to an adjacent worker dormitory module;

(v) pre-building the first module and the adjacent module to each include exterior walls at least three of which are suitable for exposure to the exterior of a building, a heat source for heating the module, a selected electrical system suitable for supporting at least some kitchen electrical requirements and at least a plumbing rough-in, accessible outside of the plumbing room and suitable for supporting at least some kitchen plumbing requirements; and (vi) assembling the first module and the adjacent module to form the worker housing complex with the first module and the adjacent module placed in communication and with interior access through the access points;

(b) separating the first module and the adjacent module such that the interior access between the first module and the adjacent module is cut off; and (c) adapting the selected electrical system and the plumbing rough-in in each of the first module and the adjacent module to form kitchens in each of the first module and the adjacent module such that the modules are configured for residential housing.

2. The method of claim 1 wherein the step of considering includes a review of the building codes for residential housing.

3. The method of claim 1 wherein the step of pre-building the selected electrical system includes installing a conduit at a position within the first module for accepting electrical cables to be installed during adapting.

4. The method of claim 1 wherein the step of pre-building the selected electrical system includes installing an electrical cable suitable for supporting an electric cooking appliance installed to a position within the first module and covered by a wall panel cover such that the electrical cable is normally hidden but accessible during adapting.

5. The method of claim 1 wherein the step of pre-building the selected electrical system includes installing at least some electrical outlets in a room of the first module at a height from a floor surface greater than a countertop height.

6. The method of claim 1 wherein the step of constructing includes installing in the plumbing room of the first module at least two operable sinks, at least two operable toilets, urinals or a combination thereof; and at least one operable shower.

7. The method of claim 1 wherein the step of constructing includes installing in the plumbing room of the first module no more than two toilets and two showers.

8. The method of claim 1 wherein the hallway includes wall panels and the method further comprises after the step of separating, removing at least some of the wall panels to remove at least a portion of the hallway.

9. The method of claim 1 wherein the step of adapting includes installing kitchen cabinets adjacent the selected electrical system and the plumbing rough-in.

10. The method of claim 1 wherein after adapting the form of the first module is one of (i) detached residential housing, (ii) semi-detached residential housing and (iii) attached residential housing.

* * * * *